United States Patent [19]

Sherman

[11] 4,156,167

[45] May 22, 1979

[54] RADIATION EMITTING SYSTEM WITH PULSE WIDTH AND FREQUENCY CONTROL

[75] Inventor: John E. Sherman, Tacoma, Wash.

[73] Assignee: Wilkins & Associates, Inc., Tacoma, Wash.

[21] Appl. No.: 704,490

[22] Filed: Jul. 12, 1976

[51] Int. Cl.[2] ..... H05B 41/24

[52] U.S. Cl. ..... 315/287

[58] Field of Search ..... 315/246, 249, 287; 340/324 M

[56] References Cited

U.S. PATENT DOCUMENTS

| | | | |
|---|---|---|---|
| 3,247,358 | 4/1966 | Schmidt | 219/240 |
| 3,307,094 | 12/1967 | Ogle | 318/341 |
| 3,403,315 | 9/1968 | Maynard | 318/227 |
| 3,515,853 | 6/1970 | McAdams | 219/346 |
| 3,725,898 | 4/1973 | Canton | 340/324 M |
| 3,740,570 | 6/1973 | Kaelin et al. | 340/324 M X |
| 3,786,485 | 1/1974 | Wojcik | 340/324 M |
| 3,893,001 | 7/1975 | Isono et al. | 315/287 |
| 3,894,229 | 12/1975 | Mouri | 250/199 |
| 3,902,060 | 8/1975 | Neuner et al. | 250/199 |
| 3,909,670 | 9/1975 | Wakamatsu et al. | 315/276 |
| 3,912,951 | 10/1975 | Kihara | 307/289 |
| 3,924,120 | 12/1975 | Cox | 250/199 |
| 3,928,760 | 12/1975 | Isoda | 358/194 |
| 3,958,127 | 12/1976 | Beck | 250/563 |
| 4,039,897 | 8/1977 | Dragoset | 315/287 X |
| 4,045,709 | 8/1977 | Morais | 315/246 X |
| 4,051,411 | 9/1977 | Knoble et al. | 315/246 X |

*Primary Examiner*—Peter A. Nelson

*Attorney, Agent, or Firm*—Dowrey & Cross

[57] ABSTRACT

The system includes a radiation emitter which is pulse driven by high current, low voltage full wave rectified direct current electrical power. Pulse frequency and width are controlled to provide periods of non-emissive operation sufficiently longer than the periods of emissive operation to maintain a desired emitter temperature. An electrically conductive case mounts the emitter in electrically conductive relation therewith and provides one current path to the emitter.

30 Claims, 1 Drawing Figure

RADIATION EMITTING SYSTEM WITH PULSE WIDTH AND FREQUENCY CONTROL

BACKGROUND OF THE INVENTION

This invention relates to radiation emitting systems.

Known radiation emitting systems include a radiation emitter, such as a light emitting diode (LED), an electrical power source for driving the emitter and, in most practical applications, a switching transistor for applying power to the emitter in pulse form under control of appropriate oscillator or switching amplifier circuitry. Typical systems of this type utilize a direct current power source, or a direct current source in combination with a charging capacitor, to drive the emitter with square wave or generally similar pulses of such width and frequency that the emitter is pulsed off and on for substantially equal intervals of time. Refer, for example, to U.S. Pat. Nos. 3,894,229, 3,928,760, 3,657,543, 3,751,671, 3,742,947, 3,909,670, 3,705,986 and 3,486,029. Another generally similar direct current system, disclosed in U.S. Pat. No. 3,727,185, utilizes a silicon controlled rectifier (SCR) to switch the emitter. Still another system, disclosed in U.S. Pat. No. 3,924,120, converts alternating current electrical power to 120 Hz square wave, the pulse width of which is controllable for information transmission to remote locations.

These and other radiation emitting systems are of limited power and, hence, tend to be short ranged, especially in dust filled or like environments. Although most commercially available semiconductor radiation emitters are capable of peak power operation for short time intervals, in most practical application —— both continuous or pulse operated — they are operated at average power levels well below peak power because of fears of excessive junction temperatures, and other factors. Thus, the effectiveness of most radiation systems heretofore has been limited by unacceptably low emitter power levels, or emitter current limiting devices, or both. The effectiveness of systems which utilize capacitive emitter charging elements are further limited by dielectric heating effects and capacitor charging time limitations.

SUMMARY OF THE INVENTION

This invention provides a radiation emitting system which includes a radiation emitter, and means for pulse-driving the emitter with electrical pulses of such frequency and width that the time period during which the emitter is inoperative (i.e. non-emissive) is sufficiently longer than the time period during which it is operative (emissive) to maintain desired emitter temperature.

According to one preferred embodiment of the invention, the emitter is pulse driven by high current, low voltage electrical power of continuously varying amplitude, the frequency and pulse width of which are controlled by pulse frequency control means and pulse width control means, respectively. The pulse frequency control means preferably include a generator for producing a square wave pulse signal of desired frequency, and the pulse width control means preferably include a one-shot pulse generator operative in response to positive transition of the square wave pulse signal for controlling the duration of each square wave pulse. The emitter additionally is mounted by a suitable electrically conductive case which constitutes one current path between a source of rectified direct current electrical power, preferably a full wave bridge rectifier, and the emitter.

Thus, it will be appreciated from the foregoing summary that this invention successfully overcomes fears heretofore associated with peak power radiation emitter operation. The frequency and width of the emitter drive pulse, of course, may vary, depending upon the characteristics of the particular emitter used and the available power source. The selection of pulse frequency further could depend upon additional factors, such as receiver efficiency (in those applications in which the radiation emitter is used with a separate receiver), desirability of pulse encoding with respect to ambient radiation, etc. The choice of a particular radiation emitter likewise will depend upon the particular application and, although optically emissive diodes which emit a beam in the near-infrared, visible or infrared regions of the optical spectrum, as the case may be, are suitable for use in this invention, other types of radiation emitters may be used, if desired. While preferably the emitter power is derived from full wave rectified direct current electrical power, other power wave forms which yield continuously varying power levels could be used if desired.

These and other features, objects and advantages of the present invention will become apparent in the detailed description and claims to follow taken in conjunction with the accompanying drawings.

DETAILED DESCRIPTION OF THE DRAWINGS

Figure 1:
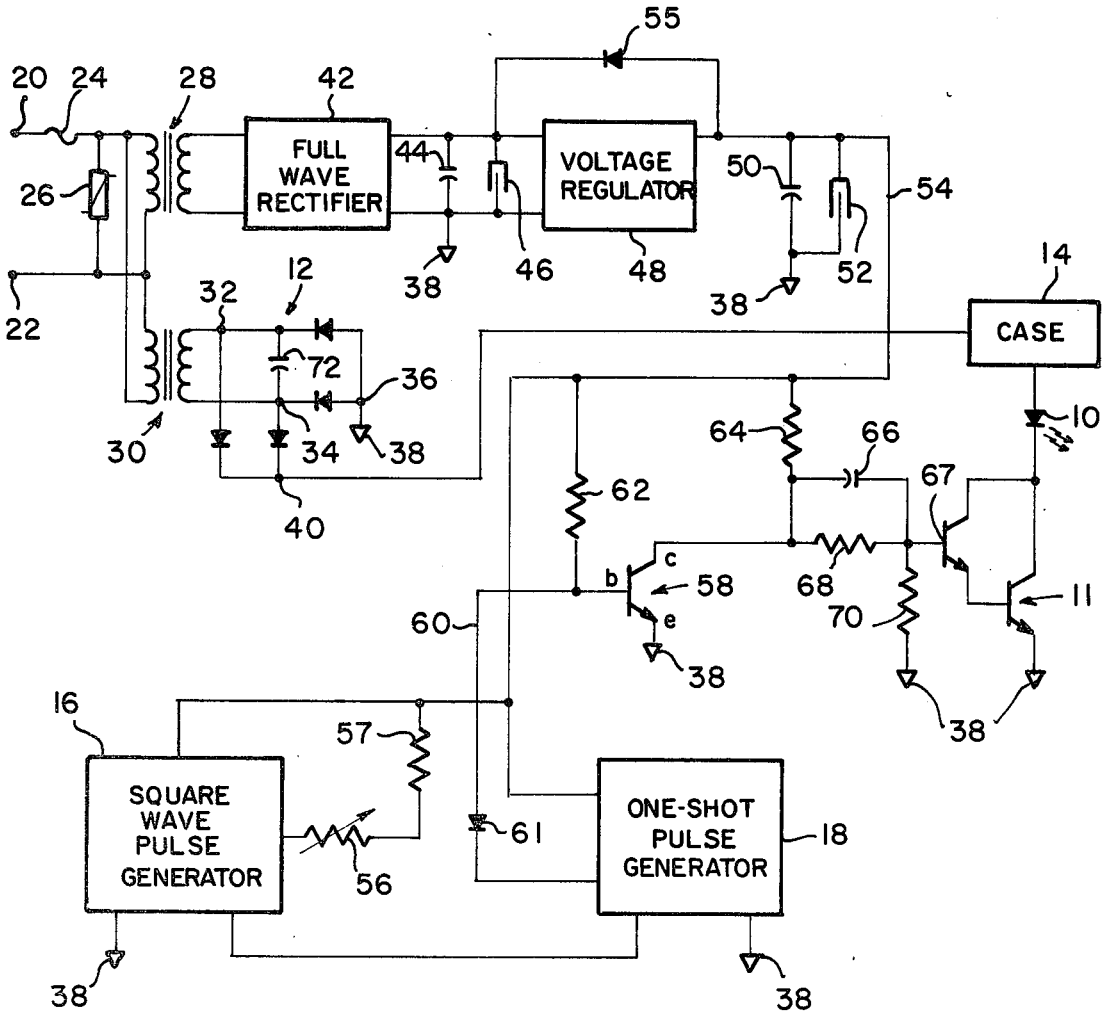
FIG. 1 is an electrical circuit schematic of the radiation emitting system of this invention.

The radiation emitting system of this invention as depicted schematically in FIG. 1 includes a radiation emitter 10, and means for pulse driving the emitter with electrical pulses of such frequency and width that the time period during which the emitter is nonemissive is sufficiently longer than the time period during which it is emissive to maintain a desired emitter temperature. The emitter is pulse driven by full wave rectified direct current electrical power of high current and low voltage, transmitted from a full wave rectifier bridge 12 via an electrically conductive case 14 which mounts the emitter in electrically conductive relation therewith. A power switching amplifier 11 pulses the emitter on and off in response to control signals representative of the frequency and pulse width of the drive pulses to be applied to the emitter. In the example, the control signals are generated by a square wave pulse generator 6 and a one-shot pulse generator 18, as will be described presently. In the example, the radiation emitter is a commercially available light emitting diode (LED) which generates an optical beam in the near-infrared, visible or infrared regions of the optical spectrum, as the case may be. It will be recognized, of course, that other types of radiation emitters may be used in the present invention.

The illustrated system is designed for use with conventional current supplies, for example 110 volt AC current supplies, although it could be modified appropriately for use with other current supplies, both AC and DC, if desired. Incoming electrical power from the current source appears at lines 20 and 22. A fuse 24 associated with line 20 protects the system against internal short circuits and acts as a current limiting means with respect to the incoming line. A voltage transient supresser 26 is connected electrically between lines 20 and 22, as shown. Two step-down transformers referenced generally by numerals 28 and 30, are connected with their primary windings across lines 20 and 21, as shown.

The emitter is driven by electrical power derived from transformer 30. The secondary winding of this transformer provides high current, low voltage electrical power to the inputs 32 and 34 of bridge 12 which thereupon converts the AC power to full wave rectified direct current electrical power of corresponding high current and low voltage. One bridge output 36 is connected with system ground 38. System ground is connected by appropriate means (not shown) with other grounded elements of the system, the other ground connection being represented by the same symbol and reference numeral. The other bridge terminal, and in this case the positive bridge terminal, referenced by numeral 40, is connected electrically with case 14. This case mounts the emitter and the various illustrated system elements. The case is, in turn, connected electrically with the emitter anode, as depicted schematically. In the example, the case is composed of electrically conductive material and, therefore, provides the positive current path for the full wave rectified direct current electrical power from the bridge terminal 40 to the emitter anode. With this construction, it is possible to eliminate electrical insulation between the case and emitter and, in this way, achieve highly efficient heat transfer between the emitter and case.

Transformer 28 also derives alternating current electrical power from the input lines 20 and 22. A full wave rectifier 42 inverts alternating current electrical power in the secondary winding of this transformer to full wave rectified direct current electrical power which is high frequency filtered and stabilized in DC level by capacitors 44 and 46, respectively. A voltage regulator 48 then produces an appropriate direct current voltage which is further filtered and stabilized by capacitor 50 and 52, respectively, to yield regulated DC control power on line 54. A diode 55 connected in parallel with the voltage regulator, as shown, provides a bypass for reverse voltage transient protection.

The control power present on line 54 is delivered to the square wave generator 16 and to the one-shot pulse generator 18. Variable resistor 56 and fixed resistor 57 selectively control the frequency of the square wave pulse generator. The square wave pulse signal of selected frequency which appears at the output of the generator 16 is routed to the generator 18. Generator 18 operates in response to each positive transition of the incoming square wave pulse train from generator 16 to deliver an appropriate control signal to amplifier 11 for applying a pulse of controlled frequency and width to emitter 10, as will now be described.

A pulse amplifier transistor 58 is connected to the output of the one-shot pulse generator via line 60 and reverse blocking diode 61. The base of transistor 58 is connected by a base pull-up resistor 62 with line 54, its collector is connected by collector pull-up resistor 64 with line 54, and its emitter is connected with ground, as shown. With the illustrated construction, transistor 58 normally is held in its conductive state in response to the voltage developed by resistor 62. When the signal which appears at the output of the one-shot pulse generator goes low, however, the transistor is rendered nonconductive, or is turned off. At this time, the collector pull-up resistor 64 impresses a voltage upon a capacitor 66 which initially speeds up coupling between line 54 and the base (referenced by numeral 67) of amplifier 11 by minimizing current draw and providing a high initial current for fast turn on of amplifier 11. Thereafter, resistor 68 delivers current from line 54 and resistor 64 to the base of the amplifier which, therefore, is now in its conductive condition for completing the current path from bridge 12, via case 14, to the emitter 10, and thence to ground. An additional resistor 70 connected to ground, as shown, also aids in turn on of amplifier 11. Amplifier 11 turns off when transistor 58 resumes its conductive state upon termination of the one-shot pulse. The remaining positive portion of the square wave pulse is thus blocked. It will be recognized, of course, that the inverted or high output of the one-shot is blocked by diode 61, and, hence is not utilized; however, by appropriate modification of the illustrated circuit, amplifier 11 could be switched in response to the high output of the one-shot.

Amplifier 11 is connected with its collector in series with the cathode of emitter 10 and with its emitter connected to ground, as shown. Amplifier 11 preferably is a two stage power switching amplifier having high collector current carrying capacity and sufficiently high gain to allow turn on by very small magnitude currents, while providing desired emitter drive current. In the example, a Darlington transistor constitutes amplifier 11, although other appropriate amplifiers could be used.

According to one specific application of the invention, a commercially available radiation emitter manufactured by Texas Instruments Corporation and designated model number TIL-31, was pulse driven in the FIG. 1 system. In this application, a square wave pulse generator frequency of 53,000 cycles per second and a one-shot pulse of one microsecond yielded peak power operation of about 15 watts — more than ten times the manufacturer's recommended pulse operational power level rating of the emitter — for prolonged periods, even at elevated ambient temperature. The emitter range was increased substantially when pulse driven in the FIG. 1 system. The optical beam emitted was dectable at a range about ten times the manufacturer's rated range. In this and other applications, a shunt capacitor 72 may be connected between the input terminals of bridge 12, as shown. In the specific application enumerated herein, the capacitance of capacitor 72 is about 0.22 microfarads.

As will now be appreciated, the 53,000 cycle per second pulse frequency produces pulses of widths substantially greater than the one microsecond one-shot pulse which, as described herein, effectively controls the width of the drive pulses applied to the emitter and in this way, the emissive and nonemissive conditions thereof with respect to a desired emitter temperature. Furthermore, the power levels of successive drive pulses will, in the example system, vary continuously with respect to peak power — corresponding to the full wave rectified power wave form. Thus, peak power will be applied in only a portion of the drive pulses, the remaining drive pulses applied being of reduced power levels; however, sufficient numbers of drive pulses are applied at or near peak power to obtain acceptable lower levels.

Although one preferred embodiment of the invention has been illustrated and described herein, variations will become apparent to one of ordinary skill in the art. Accordingly, the invention is not to be limited to the specific embodiment illustrated and described herein and the true scope and spirit of the invention are to be determined by reference to the appended claims.

The embodiments of the invention in which an exclusive property or privilege is claimed are defined as follows:

1. A radiation emitting system, comprising: an emitter of radiation energizable in response to application of electrical power thereto; and means connected with said emitter for applying high current low voltage electrical power of continuously varying amplitude to said emitter in pulses while simultaneously therewith controlling the frequency and width of said pulses such that the time period during which said emitter is nonemissive while de-energized is sufficiently longer than the time period during which it is emissive while energized to maintain a desired emitter temperature.

2. The system of claim 1, wherein said means comprise drive circuit means which include switch means triggerable by a trigger pulse for energizing said emitter while triggered, and control circuit means connected with said switch means for triggering said switch means, said control circuit means including pulse frequency control means for controlling the frequency at which said switch means are triggered to cause said emitter to be energized at intervals, and pulse width control means for causing said emitter to be energized commencing at each said interval for a predetermined time period less than one said interval, said pulse frequency control means including means for controlling the frequency at which said intervals occur such that each said interval corresponds to at least a plurality of said predetermined time periods to control application of said power with respect to variation in amplitude thereof with time.

3. The system of claim 2, wherein said pulse frequency control means include means for generating a square wave pulse signal of desired frequency, and said pulse width control means include one-shot pulse generating means interposed between said square wave pulse generating means and said switch means and operative in response to positive transition of said square wave signal for generating a trigger pulse which persists for said predetermined time period.

4. The system of claim 3, wherein said switch means include high gain switching amplifier means, and wherein said control circuit means include means responsive to a trigger pulse for switching said amplifier means.

5. The system of claim 4, wherein said control circuit means include means converting alternating current electrical power to regulated direct current electrical power and applying said power to said square wave pulse generating means, said one-shot pulse generating means, and said switching amplifier means.

6. The system of claim 2, further comprising electrically conductive case means mounting said emitter and constituting an electrical current path for transmitting said pulses thereto, and wherein said drive circuit means include means for converting alternating current electrical power to rectified direct current electrical power of high current and low voltage, and means for transmitting said direct current electrical power through said case means to said emitter.

7. The system of claim 6, wherein said means for converting alternating current electrical power to direct current electrical power include a full wave rectifier bridge having two inputs, and a capacitor connected electrically between said bridge inputs.

8. The system of claim 1, further comprising electrically conductive case means mounting said emitter and constituting an electrical current path for transmitting said pulses thereto.

9. A circuit for driving an emitter of radiation energizable in response to application of electrical power thereto, the circuit comprising: means connected with said emitter for applying high current low voltage electrical power of continuously varying amplitude to said emitter in pulses while simultaneously therewith controlling the frequency and width of said pulses such that the time period during which said emitter is nonemissive while de-energized is sufficiently longer than the time period during which it is emissive while energized to maintain a desired emitter temperature.

10. The circuit of claim 9, wherein said means comprise drive circuit means which include switch means triggerable by a trigger pulse for energizing said emitter while triggered, and control circuit means connected with said switch means for triggering said switch means, said control circuit means including pulse frequency control means for controlling the frequency at which said switch means are triggered to cause said emitter to be energized at intervals, and pulse width control means for causing said emitter to be energized commencing at each said interval for a predetermined time period less than one said interval, said pulse frequency control means including means for controlling the frequency at which said intervals occur such that each said interval corresponds to at least a plurality of said predetermined time periods to control application of said power with respect to variation in amplitude thereof with time.

11. The circuit of claim 10, wherein said pulse frequency control means include means for generating a square wave pulse signal of desired frequency, and said pulse width control means include one-shot pulse generating means interposed between said square wave pulse generating means and said switch means and operative in response to positive transition of said square wave signal for generating a trigger pulse which persists for said predetermined time period.

12. The circuit of claim 11, wherein said switch means include high gain switching amplifier means, and wherein said control circuit means include means responsive to a trigger pulse for switching said amplifier means.

13. The circuit of claim 12, wherein said control circuit means include means for converting alternating current electrical power to regulated direct current electrical power and applying such power to said square wave pulse generating means, said one-shot pulse generating means, and said switching amplifier means.

14. The circuit of claim 10, wherein said drive circuit means include means for converting alternating current electrical power to rectified direct current electrical power of high current and low voltage.

15. The circuit of claim 14, wherein said means for converting alternating current electrical power to direct current electrical power include a full wave rectifier bridge having two inputs, and a capacitor connected electrically between said bridge inputs.

16. A circuit for driving an electrically responsive energy emitter, the circuit comprising: means connected with said emitter for applying electrical power of continuously varying current amplitude to said emitter in pulses while simultaneously therewith controlling the frequency and width of said pulses such that the time period during which said emitter is de-energized is sufficiently longer than the time period during which it is energized to maintain a desired emitter temperature.

17. The circuit of claim 16, wherein said means include means for causing said pulses to be applied to said emitter at intervals for a predetermined time period with the frequency at which said intervals occur being sufficient that each said interval corresponds to at least a plurality of said predetermined time periods to control application of said pulses with respect to variation in current amplitude of the electrical power with time.

18. The circuit of claim 17, including means for controlling the frequency at which said intervals occur.

19. The circuit of claim 16, wherein said means include means connectable to a source of alternating current electrical power providing electrical drive power in the form of a plurality of unidirectional drive pulses in synchronism with the alternating current for energizing the emitter, means including semi-conductor switch means triggerable by a trigger pulse for applying said drive power to the emitter to effect energization thereof while triggering, means connectable to the power source providing a plurality of unidirectional control pulses in synchronism with the alternating current, means squaring said control pulses to provide a plurality of unidirectional square wave pulses, square wave responsive trigger pulse means providing a plurality of trigger pulses for triggering said switch means at intervals to effect energization of the emitter, each said trigger pulse persisting for a predetermined time period, the frequency at which said intervals occur being sufficient that each said interval corresponds to at least a plurality of said predetermined time periods to control application of said pulses with respect to variation in current amplitude of the electrical power with time.

20. The circuit of claim 19, wherein said trigger pulse means provide a trigger pulse in response to positive transition of each said square wave pulse.

21. The circuit of claim 19, wherein the frequency at which said intervals occur is sufficiently greater than the frequency of the alternating current that one cycle of the alternating current corresponds to a plurality of said intervals.

22. The circuit of claim 16, wherein the emitter comprises an emitter of electromagnetic radiation in the optical spectrum.

23. A circuit for use with an electrical device having an element which is energizable by electrical current, a source of electrical current which varies continuously in amplitude with time, and a drive circuit having a switch alternately causing current to flow from the source to the element when the switfch is conductive and preventing current flow from the source to the element when the switch is non-conductive, the circuit comprising means for causing the switch to become conductive at intervals for a predetermined time period with the frequency at which said intervals occur being sufficient that each said interval corresponds to at least a plurality of said time periods to control application of the current with respect to variation in amplitude thereof with time, whereby the element may be energized by electrical current having an overload amplitude without damaging the element.

24. The circuit of claim 23, including means for controlling the frequency at which said intervals occur.

25. The circuit of claim 23, wherein said means include clock pulse means providing clock pulses which occur in synchronism with amplitude variations of the electrical current, and clock pulse responsive trigger pulse means for triggering the switch conductive at said intervals by application of a trigger pulse which persists for said time period.

26. The circuit of claim 25, wherein the source of electrical current provides alternating electrical current and further including means providing a plurality of unidirectional control pulses in synchronism with the alternating current, said clock pulse means including means squaring said control pulses to provide a plurality of unidirectional square wave pulses, and said trigger pulse means including means for triggering the switch conductive responsive to positive transitions of said square wave pulses.

27. The circuit of claim 26, wherein said square wave responsive means provide a trigger pulse in response to positive transition of each said square wave pulse.

28. The circuit of claim 26, wherein the frequency at which said intervals occur is sufficiently greater than the frequency of the alternating current that one cycle of the alternating current corresponds to a plurality of said intervals.

29. The circuit of claim 23, wherein the element comprises an emitter of electromagnetic radiation in the optical spectrum.

30. A circuit for controlling application of electrical current to an electrical element, the current varying continuously in amplitude with time, the circuit comprising means for causing such current to be applied to the element at intervals for a predetermined time period with the frequency at which said intervals occur being sufficient that each said interval corresponds to at least a plurality of said time periods to control application of such current with respect to variation in amplitude thereof with time, whereby such electrical current of an overload amplitude may be applied to the element without damage thereto.

* * * * *